United States Patent [19]

Bradshaw

[11] 4,348,817

[45] Sep. 14, 1982

[54] DRYING APPARATUS

[75] Inventor: William Bradshaw, Rimington, nr. Clitheroe, England

[73] Assignee: Edgar Pickering (Blackburn) Ltd., Lancashire, England

[21] Appl. No.: 146,431

[22] Filed: May 5, 1980

[30] Foreign Application Priority Data

| | | | |
|---|---|---|---|
| May 11, 1979 | [GB] | United Kingdom | 7916514 |
| Oct. 1, 1979 | [GB] | United Kingdom | 7933983 |
| Feb. 13, 1980 | [GB] | United Kingdom | 8004758 |

[51] Int. Cl.[3] ..... F26B 21/08

[52] U.S. Cl. ..... 34/75; 34/76; 34/86; 34/84; 34/242

[58] Field of Search ..... 34/92, 77, 86, 35, 76, 34/83, 84, 75, 242; 165/104 F; 68/5 C, 5 D, 5 E, 18 C

[56] References Cited

U.S. PATENT DOCUMENTS

| | | | |
|---|---|---|---|
| 2,622,342 | 12/1952 | Gouldunes et al. | 34/169 |
| 4,053,990 | 10/1977 | Bielinski | 34/92 |
| 4,102,158 | 7/1978 | Sando et al. | 34/242 |
| 4,121,091 | 10/1978 | Wareham | 165/104 |
| 4,250,628 | 2/1981 | Smith et al. | 34/84 |

*Primary Examiner*—Larry I. Schwartz

*Attorney, Agent, or Firm*—Watson, Cole, Grindle & Watson

[57] ABSTRACT

An apparatus for drying fabric and other materials comprises a vacuum chamber to contain the fabric, a condenser for condensing vapor generated from the fabric in the vaccum chamber, a heat exchanger in the vacuum chamber through which the condensate is passed and a heater for supplying heat to the condensate on its way from the condenser to the heat exchanger. Preferably the fabric is drawn continuously through the chamber through an inlet and an outlet both provided with vacuum seals.

20 Claims, 10 Drawing Figures

DRYING APPARATUS

Figure 1:
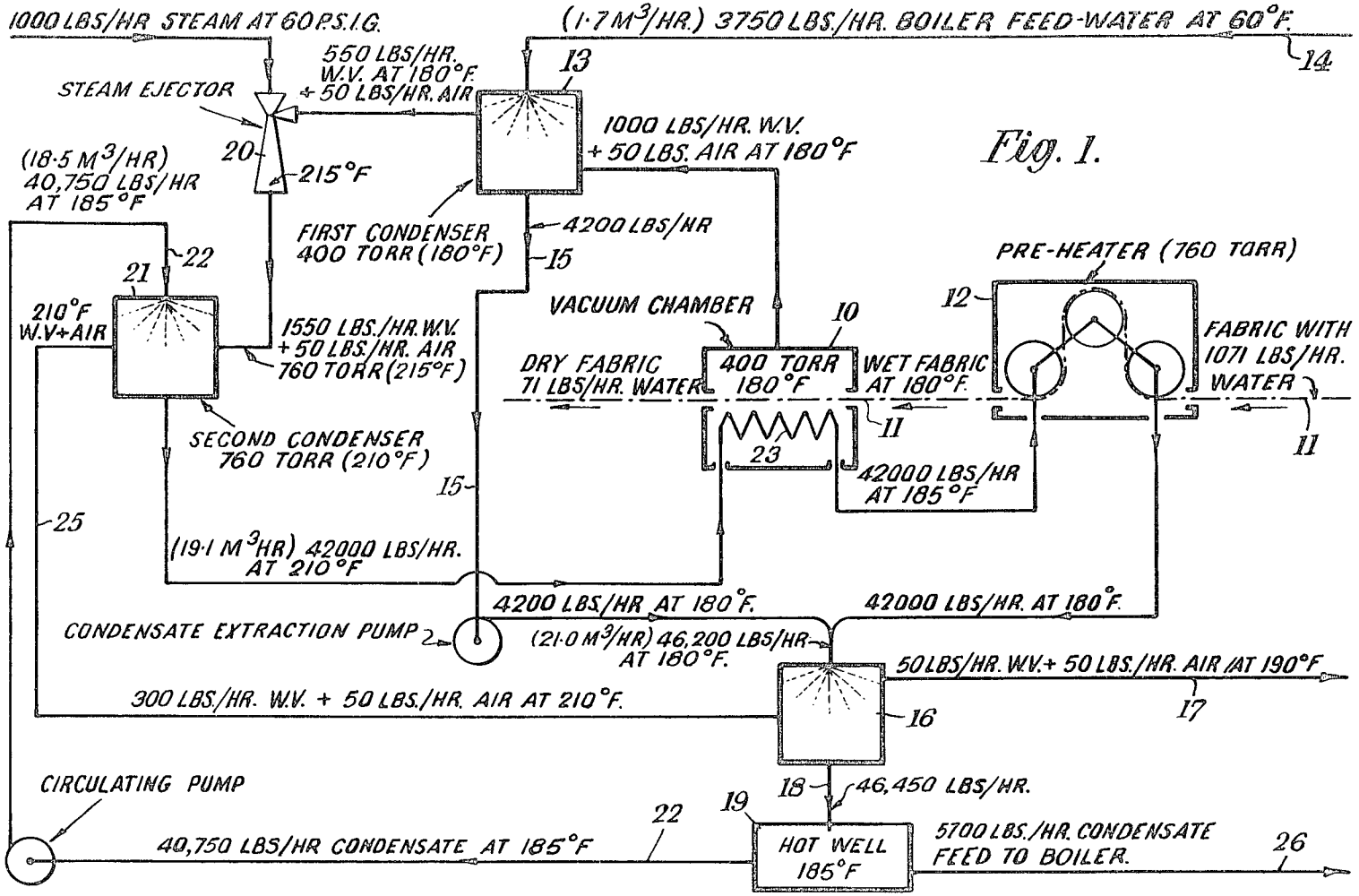

Fabrics and other materials in sheet form are normally dried by drawing them continuously through a chamber in which hot air is circulated by fans. This procedure involves heavy expenditure in energy for heating the air and driving the fans.

The present invention is based on the appreciation that the low boiling characteristic of a vacuum system permits of a very substantial saving in running cost of a drying system, whether this operates batchwise or continuously.

In a normal drier, the vapour from the fabric or other material subjected to drying is lost, notwithstanding its high energy potential. The invention aims at reclaiming the latent heat of evaporation within the vapour by condensing the vapour and returning the condensate to the material by a heat exchanger from which the material can absorb heat.

In a typical example, 1 lb. of water vapour is capable of expanding into a volume of almost 27 cubic feet when heated to 212° F. at atmospheric pressure. When, however, the water is heated under subatmospheric pressure the volume taken up by 1 lb. of water vapour increases correspondingly, e.g.

1 lb. of water vapour at 600 torr displaces 34 (approx.) cubic feet 1 lb. of water vapour at 100 torr displaces 180 (approx.) cubic feet 1 lb. of water vapour at 50 torr displaces 350 (approx.) cubic feet 1 lb. of water vapour at 25 torr displaces 670 (approx.) cubic feet From these figures it can be seen that a vacuum system that was removing several pounds of water vapour per minute would require an enormous mechanical pump to take away this vapour. However if these large volumes are converted back into a liquid then only a small volume of condensate needs to be pumped away.

The invention accordingly provides a drying apparatus comprising a chamber to contain material to be dried, means for producing a subatmospheric pressure in the chamber, means for supplying condensate produced from vapour generated in the chamber from the material to be dried to a heat exchanger into the chamber which imparts heat to the material, and means for supplying energy to the condensate before its return to the heat exchanger.

Preferably the apparatus according to the invention includes a condenser external to the chamber in which the vapour generated in the chamber is condensed and from which the condensate is passed to the heat exchanger. Energy may, in this case, be supplied to the vapour by passage of the vapour through a compressor on its way to the condenser, by supplying top-up heat to the condensate on its way from the condenser to the heat exchanger or by use of both expedients.

Subatmospheric pressure may be produced in the chamber by a vacuum pump or by a jet ejector external to the chamber through which steam or hot water flows longitudinally and which has a lateral inlet for vapour from the chamber. In this case the jet ejector will be effective to condense entrain the vapour and also to impart heat to the condensate.

If we consider as an example a vacuum system working at a pressure of 70 torr then we know that at this pressure 1 lb. of water vapour will displace approximately 250 cubic feet.

It now follows that if we recondense this vapour then it will do two very important things.

a. It will revert back to its original volume (approx. 28 cu. inches), which gives a self perpetuating vacuum system.

b. It gives up the latent heat of evaporation to the colder surface that it meets. (This is the heat of desorbtion).

Now we can see that we have, in theory, a perfect heat cycle.

Obviously no system is 100% efficient and therefore some form of 'top-up' heat, or alternatively compression of the vapour, is required.

The dryuing apparatus according to the invention may operate batchwise or continuously. In the latter case it is, of course, necessary to provide vacuum seals at the points where the material to be dried enters and leaves the vacuum chamber. As explained later, roller type or liquid seals may be used for the purpose.

While the following description largely relates to the drying of fabrics it is to be understood that the apparatus according to the invention is also of utility in drying other materials.

Figure 2:
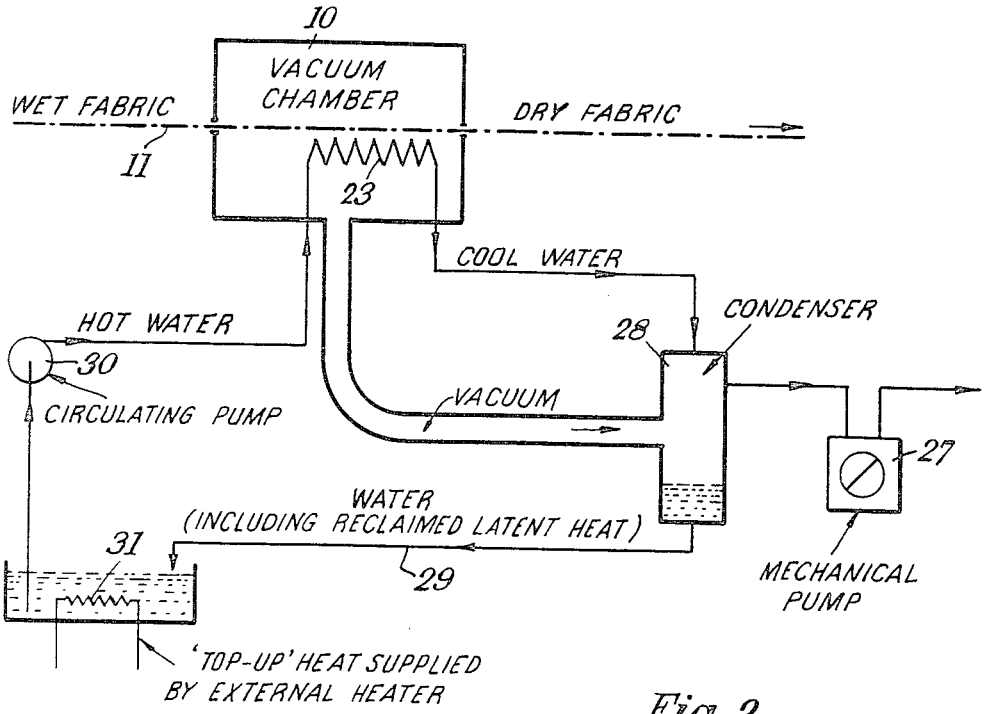
Figure 3:
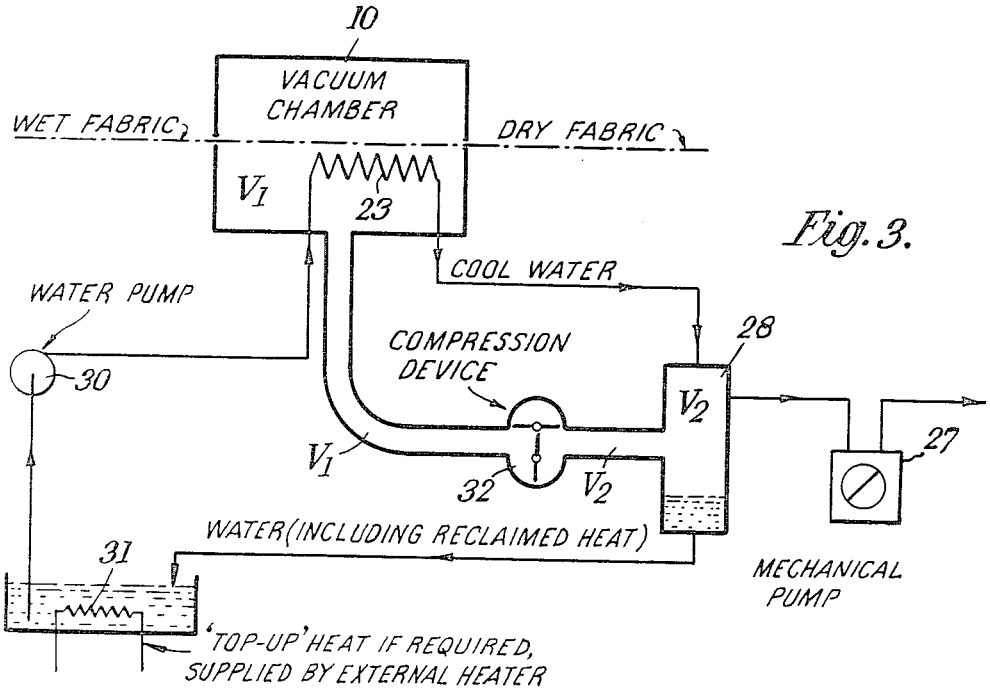
Figure 4:
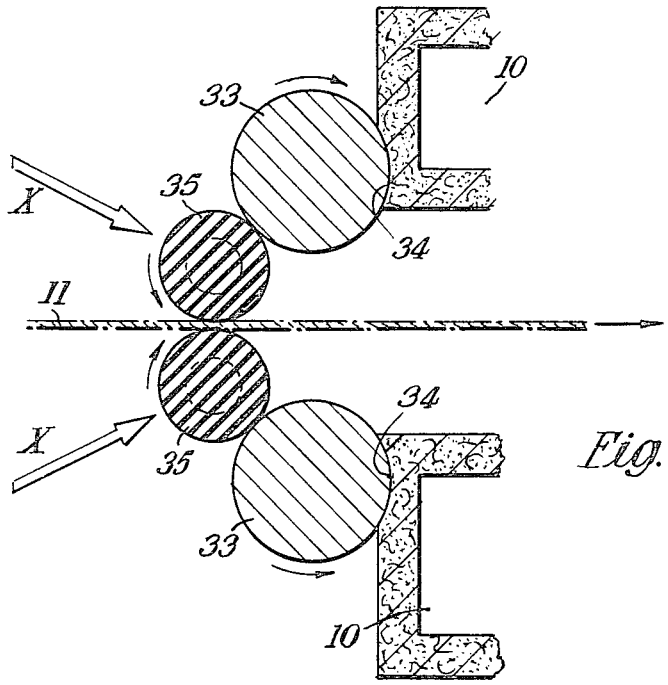
Figure 5:
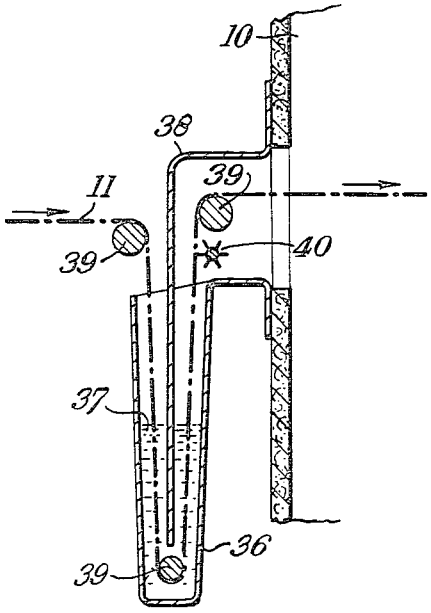
Figure 6:
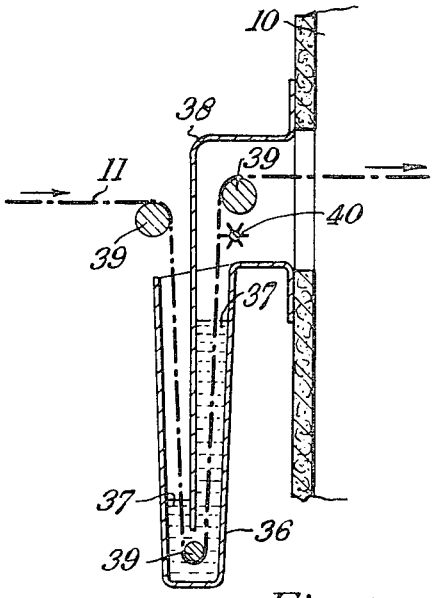
Figure 7:
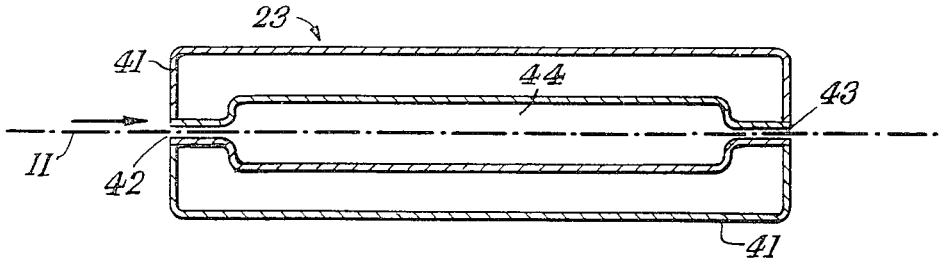
Figure 8:
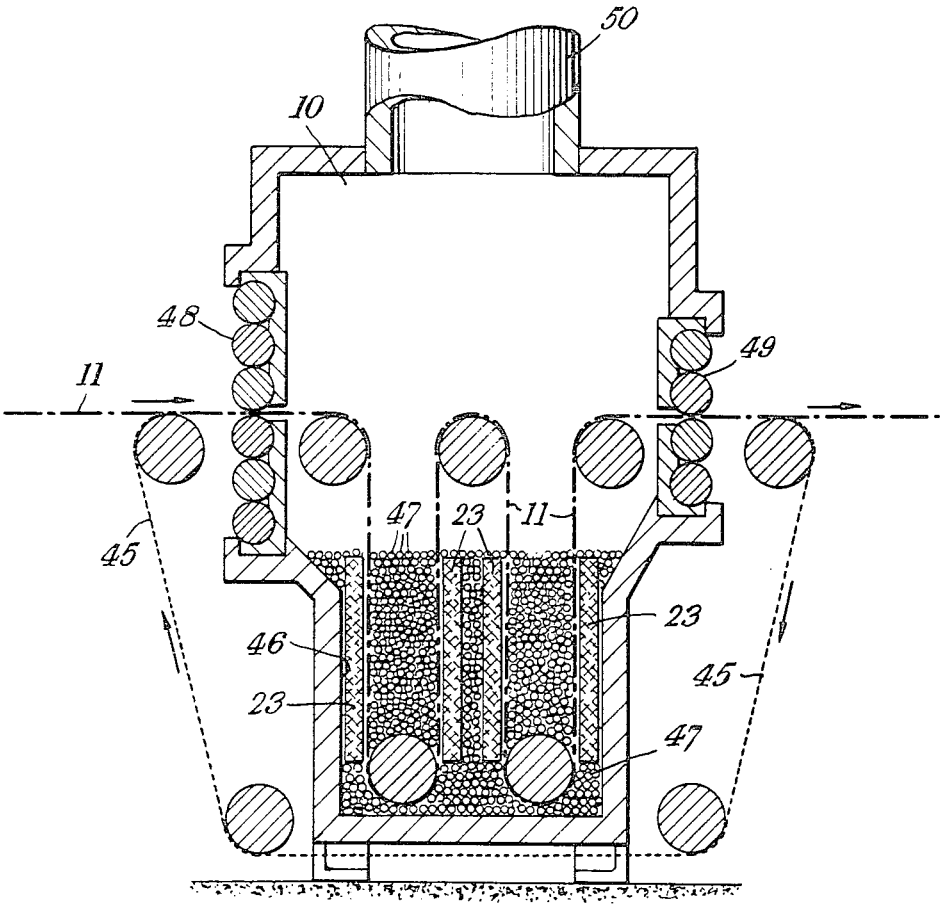
Figure 9:
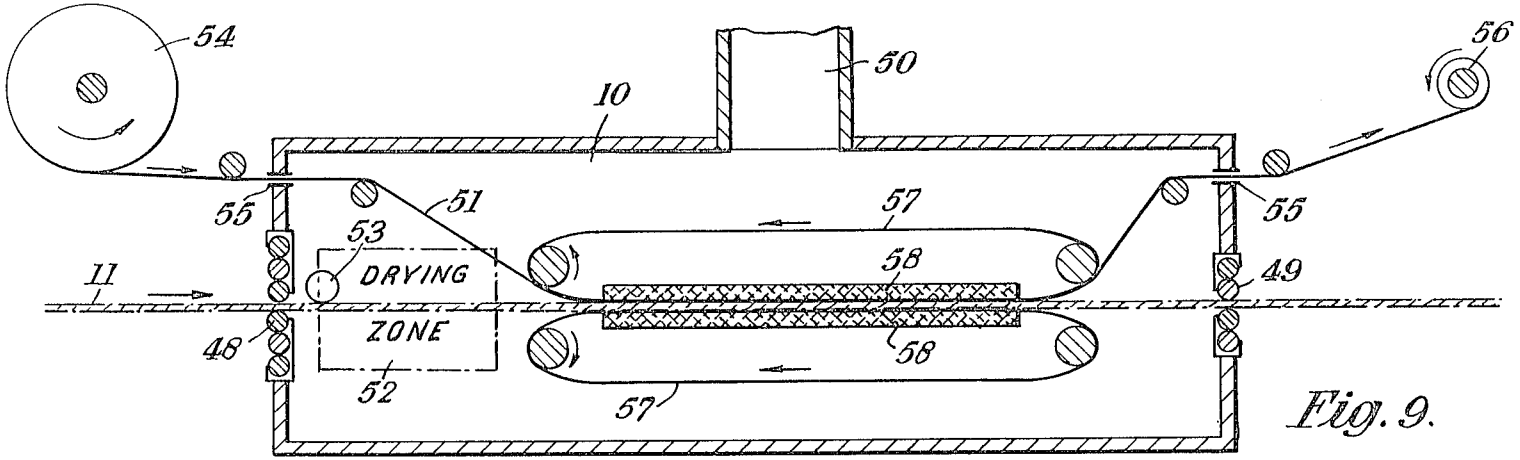
Figure 10:
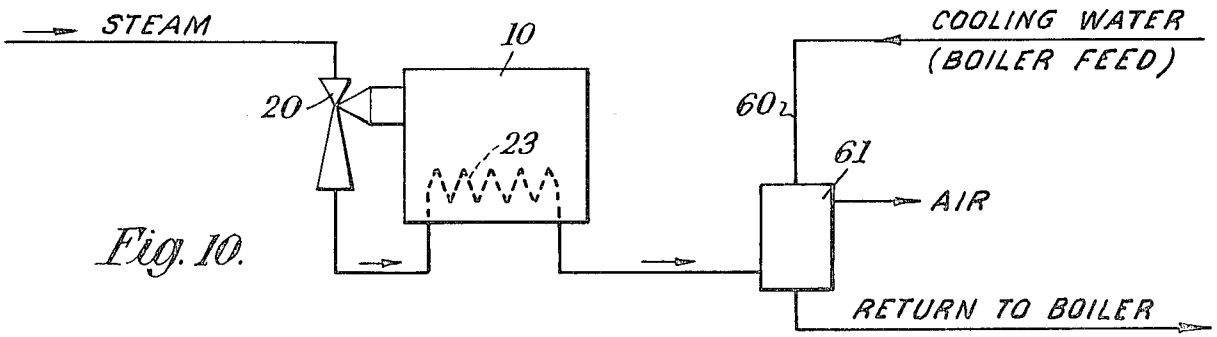

Certain embodiments of the invention will now be described, by way of example, with reference to the accompanying drawings, in which:

FIG. 1 is a block diagram of one form of drying apparatus according to the invention, FIG. 2 is a block diagram of a second form of drying apparatus, FIG. 3 is a block diagram of a third form of drying apparatus, FIG. 4 illustrates a roller type vacuum seal, FIGS. 5 and 6 illustrate a liquid seal, FIG. 7 shows a heat exchanger, FIG. 8 shows another form of heat exchanger, and FIG. 9 shows a vacuum drying apparatus which also effects continuous transfer printing onto tufted carpet to be dried, and FIG. 10 is a block diagram of another form of drying apparatus.

The apparatus shown in FIG. 1 provides for evaporation from fabric of 1000 lbs. of water per hour from textile fabric. For this approximately 1,000,000 B.T.U.'s have to be given to the water so that evaporation can take place. The latent heat can only be contained in the vapour and therefore if this vapour, which has been evaporated from the fabric is converted back into a liquid, then it must give back the latent heat, i.e. in the example 1,000,000 B.T.U.'s. Accordingly there is almost enough heat available to evaporate water continually from the fabric by returning the reclaimed latent heat back to the incoming fabric. Obviously this situation is unattainable in practice because of heat losses, introduction of cold water and other factors. It is therefore necessary to supplement the amount of heat available. In the system shown, this is done by the use of heat which is available from a secondary source, i.e. a vacuum pump. This vacuum pump takes the form of a steam ejector and it is most important to note that the steam passing through the ejector is governed by its entrainment ability rather than its heat content. Since the steam contains heat this can be used to top-up the thermal requirements of the system.

The system shown in FIG. 1, includes a vacuum chamber 10, operating at a pressure of 400 torr, through which wet fabric 11 is continuously passed after passage through a preheater 12 in which the fabric is preheated to 180° F.

The example under discussion assumes (a) An extraction of 1,000 lbs of water per hour.

(b) A residual moisture requirement of 71 lbs of water per hour.

(c) An entrainment of air @ 50 lbs per hour.

The water evaporated from the fabric, (1,000 lbs/hr W.V. +50 lbs/hr air), due to the reduction of pressure is carried to a condenser 13 in which 45% of the vapour is condensed by contact with incoming boiler feed water 14 to give a condensate temperature of 180° F. This condensate 15 is passed to a condenser 16 where the entrained air 17 is discharged to atmosphere and from which the condensate 18 passes into a reservoir 19 (hot well).

The remaining 55% of the vapour passes through the condenser and is entrained in steam which is passing longitudinally through an ejector 20 having a lateral inlet for the vapour which reduces the temperature of the steam and the steam and vapour pass from the ejector 20 into a further condenser 21. The steam ejector 20 induces the required vacuum in the vacuum chamber 10.

Water 22 at a temperature of 185° F. flows into the condenser 21 from the hot well 19 and the condensate, at a temperature of 210° F., flows from this condenser through a heat exchanger 23 in the vacuum chamber 10, giving up heat to the fabric 11, and thence through the preheater 12 to the condenser 16 and the hot well 19. Air and water vapour 25 pass from the condenser 21 to the condenser 16. Condensate 26 flows from the hot well 19 to the boiler.

In the apparatus shown in FIG. 2, vacuum is generated in the vacuum chamber 10 by a mechanical pump 27 instead of by a steam ejector. The vapour produced in the vacuum chamber is condensed in a condenser 28 and the condensate 29 is returned to the heat exchanger 23 by a circulating pump 30, receiving top-up heat on its way to the heat exchanger from an external heater 31. In the condenser 28 the vapour is cooled by the water leaving the heat exchanger 23.

The apparatus shown in FIG. 3 is generally similar to that shown in FIG. 2 but includes a compressor 32 for compressing the vapour on its way from the vacuum chamber 10 to the condenser 28. The vacuum $V_1$ prevailing in the vacuum chamber is higher (e.g. 50 torr) than that $V_2$ (e.g. 100 torr) prevailing in the condenser 28.

FIG. 4 illustrates a roller type vacuum seal for use at the inlet to the vacuum chamber 10. An identical seal may be provided at the outlet through which the fabric leaves the vacuum chamber. The seal illustrated consists of four rollers, namely two outer metal rollers 33 which bear against seatings 34 on the housing of the vacuum chamber, and two centre rubber rollers 35 disposed outwardly of the rollers 10 and forming a nip for passage of the fabric 11 to be dried in the chamber. External atmospheric pressure and the reaction of the rollers 33 impose on each of the rollers 35 a resultant load in the direction of the arrows X. The rollers 35 therefore act to squeeze free moisture from the fabric so rendering it unnecessary to provide a separate mangle such as is normally required to remove moisture from fabric before it enters a drying chamber.

One or more further pairs of rollers may, if desired, be disposed between the rollers 35 and the rollers 33.

FIGS. 5 and 6 illustrate a liquid seal for use at the inlet to the vacuum chamber 10. A similar seal may be provided at the outlet. The seal includes a bath 36 containing liquid 37 into which dips a barrier 38 preventing access of atmospheric air to the interior of the vacuum chamber. The fabric 11 to be dried is guided by rollers 39 to traverse the liquid in a U-shaped path as shown. The liquid 37 is one which does not readily wet the fabric and is heated to a temperature approaching but below the boiling point of water under the level of vacuum applied to the chamber. It is preferably a molten metal, e.g. Wood's metal or Lipowitz' metal, but it may be a silicone.

FIG. 5 shows the metal when the vacuum chamber 10 is at atmospheric pressure and, therefore, the pressure at the surface of the metal is equal on both sides of the barrier 38. As a vacuum is applied in the vessel, the respective pressures at surfaces of the metal on opposite sides of the barrier will vary and the difference in levels will become a function of the density of the particular metal and the degree of vacuum. This is as shown in FIG. 6.

To avoid any carry over of the metal which may attach itself to the surface of the fabric a vibration device 40 is incorporated which dissociates any metal and allows it to fall back into the bath.

When it is desired to dry fabrics which have been treated with an organic solvent and subsequently washed with water, the heat provided by the seal will remove residual solvent which boils out into the vacuum chamber and can be collected in a suitable condenser which can provide for separate condensation of different solvents. It is not, of course, necessary for the liquid forming the seal at the outlet to be heated except to the extent required to maintain it liquid.

FIG. 7 shows one form of heat exchanger 23 for use in the vacuum chamber 10. It consists of two plates 41, through which the condensate circulates, which are separated by small inlet and outlet gaps 42, 43 yielding a very small clearance for passage of the fabric 11 between the plates.

Since the fabric 11 enters the space between the platens at 42, it will be at a temperature that balances with the vacuum level (saturated vapour pressure), and no vapour will be leaving the surface. As the heat raises the temperature of the fabric vapour is evolved. The gaps 42, 43 are designed to act as restrictors to the gas flow, so that the vapour generated in the interspace 44 is at a higher pressure. This gives high thermal conductivity from the heat source to the fabric, i.e. conduction and convection plus radiation.

Normally in a vacuum system only radiated heat is available for transfer of heat to the fabric to be dried. This can be mitigated by surrounding the heat exchanger or exchangers with a heat transfer medium, e.g. free-flowing glass microspheres, through which the fabric is drawn and which conduct heat to it as illustrated in FIG. 8. In the apparatus the fabric 11 is drawn by stenter chains, one of which is shown at 45, so that it passes through a space 46 in the chamber 10 surrounding the heat exchangers 23 which is filled with glass microspheres 47. Alternatively the space 46 may contain a molten low melting point metal, e.g. Wood's metal, which is not injurious to the fabric. The chamber shown in FIG. 8 has inlet and outlet vacuum seals 48, 49 and an outlet 50 connected to a vacuum pump.

One of the most important aspects of this method of drying is the fact that the thermal energy required to remove 1 lb. of water from the fabric is so low, e.g. at 70 torr it is less than the potential energy of the water itself. At a pressure of 70 torr the latent heat of vaporisation is 880 B.T.U's/lb. and most of this requirement is supplied in the form of desorbed heat from the condenser.

Drying can therefore be carried out at only a fraction of the heat costs of existing systems, and total uniformity of moisture level can be attained due to the vapour diffusion at low temperatures.

FIG. 9 shows that a drying apparatus according to the invention, in addition to providing a drying zone which operates as already described, may also be used to print from transfer paper 51 onto a carpet 11 or other substrate after drying.

In this system, the carpet is fed into the chamber 10 via a vacuum seal 48 and before entering a drying zone 52 the carpet fibres are realigned by a fibre 'teasing' roller 53. This is particularly important for man made fabrics that have a long plastic memory. In the drying zone 52 water is evaporated from the carpet by a heat exchanger (not shown) as in the embodiments previously described. The transfer paper 51, which is fed from a reel 54, enters and emerges from the chamber via static seals 55 and is wound upon a take-up reel 56. Beyond the drying zone, the transfer paper and the carpet are brought together between metal belts 57 and temperature controlled heating platens 58.

In the drying apparatus shown in FIG. 10, the vapour generated in the vacuum chamber is passed directly to the lateral inlet of a steam ejector 20 from which condensate produced by condensation of the vapour is passed directly to the heat exchanger 23 in the chamber. The condensate leaving the heat exchanger supplies heat to boiler feed water 60 in a condenser 61.

I claim:

1. Apparatus for drying a material by removing a quantity of a wetting liquid from the material in the form of a vapour, through evaporation of the wetting liquid from the material, the apparatus comprising:

i. a drying chamber;

ii. a vapour condenser in which at least some of the vapour is contacted by a supply of the wetting liquid thereby to condense the vapour in the liquid supply and transfer the associated latent heat of condensation to the supply of wetting liquid;

iii. a reservoir for the heated wetting liquid, including condensed vapour, from the condenser;

iv. means to maintain the temperature of the reservoir higher than the temperature of the vapour in the drying chamber;

v. fluid connections between the chamber and the condenser, and the condenser and the reservoir;

vi. means for flowing the vapour from the chamber to the condenser;

vii. a heat exchanger within the drying chamber for imparting heat to the material to be dried;

viii. a fluid connection between the reservoir and the heat exchanger; and ix. means for flowing the wetting liquid from the reservoir to and through the heat exchanger; whereby such latent heat as is given out by condensation of the vapour within the condenser is absorbed by the liquid supply and carried thereby from said condenser to the heat exchanger for heating the material to be dried.

2. A drying apparatus as claimed in claim 1, wherein said means to maintain the high reservoir temperature and for flowing the vapour from the chamber to the condenser comprises a jet ejector.

3. A drying apparatus as claimed in claim 2, wherein said jet ejector constitutes said vapour condenser.

4. A drying apparatus as claimed in claim 2, wherein said jet ejector is located in the fluid connection between the drying chamber and the condenser.

5. A drying apparatus as claimed in claim 2, including a further condenser located in the fluid connection between the jet ejector and the drying chamber.

6. A drying apparatus as claimed in claim 5, including means to convey condensate from the further condenser to said vapour condenser to provide or contribute to the supply of wetting liquid.

7. A drying apparatus as claimed in claim 1, including a preheating means for said material, and means to convey the wetting liquid from said heat exchanger to said preheating means for further heat-exchange with the material to be dried.

8. A drying apparatus as claimed in claim 1 or 7, including a downstream condenser in which a flow of vapour from said vapour condenser is condensed, downstream of its heat-exchange with the material to be dried, in a supply of the wetting liquid.

9. A drying apparatus as claimed in claim 8, wherein a fluid flow passage is provided for flow of condensate from the downstream condenser to said vapour condenser to provide or contribute to said supply of wetting liquid.

10. A drying apparatus as claimed in claim 1, wherein the means to maintain a high reservoir temperature comprises a heater in the reservoir.

11. A drying apparatus as claimed in claim 1, wherein the means for flowing vapour from the chamber to the condenser is a compressor in the connection between the chamber and the condenser.

12. A drying apparatus as claimed in claim 10, wherein the means for flowing vapour comprises a vacuum pump located downstream of the condenser.

13. A drying apparatus according to claim 1, in which the chamber has an inlet and an outlet for continuous passage through the chamber of sheet material to be dried and vacuum seals at the inlet and at the outlet.

14. A drying apparatus according to claim 13, in which each vacuum seal comprises a pair of outer rollers which bear against surfaces on the exterior of the chamber and a centre pair of rollers outwardly offset from the outer rollers which apply pressure to the outer rollers, have resilient surfaces and provide a nip for passage of the sheet material.

15. A drying apparatus according to claim 13, in which each vacuum seal comprises a bath containing liquid which does not wet the fabric and into which dips a barrier preventing access to atmospheric air to the interior of the chamber, means for heating the bath and means for guiding the sheet material through the bath and beneath the lower end of the barrier in U-formation.

16. A drying apparatus according to claim 15, in which the liquid is a molten metal.

17. A drying apparatus according to claim 13, wherein the heat exchanger comprises plates through which the condensate circulates and which are separated by narrow inlet and outlet gaps for passage of the sheet material and an intervening space in which vapour from the sheet material is generated.

18. A drying apparatus according to claim 13, wherein the heat exchanger is surrounded by a heat transfer medium through which the sheet material is traversed to receive heat by conduction.

19. A drying apparatus according to claim 18, wherein the heat transfer comprises free flowing glass microspheres.

20. A drying apparatus according to claim 13, which includes means for traversing a transfer paper through the chamber and bringing it into printing contact with the sheet material at a location beyond the heat exchanger.

* * * * *